US009735504B2

(12) United States Patent
Wimmer

(10) Patent No.: US 9,735,504 B2
(45) Date of Patent: Aug. 15, 2017

(54) ELECTRICAL CONNECTOR AND ELECTRICAL PLUG CONNECTION

(71) Applicant: Lisa Draexlmaier GmbH, Vilsbiburg (DE)

(72) Inventor: Stefan Wimmer, Hohenthann (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/245,694

(22) Filed: Aug. 24, 2016

(65) Prior Publication Data

US 2017/0062980 A1 Mar. 2, 2017

(30) Foreign Application Priority Data

Aug. 25, 2015 (DE) ..... 10 2015 114 080

(51) Int. Cl.

| | |
|---|---|
| ***H01R 13/193*** | (2006.01) |
| ***H01R 13/627*** | (2006.01) |
| ***H01R 13/631*** | (2006.01) |
| ***H01R 13/53*** | (2006.01) |

(52) U.S. Cl.

CPC ..... *H01R 13/631* (2013.01); *H01R 13/193* (2013.01); *H01R 13/53* (2013.01); *H01R 13/6272* (2013.01); *H01R 2201/26* (2013.01)

(58) Field of Classification Search

CPC H01R 13/6272; H01R 13/193; H01R 13/631; H01R 13/53; H01R 2201/26; H01R 23/6833

USPC ..... 439/259, 352

See application file for complete search history.

(56) References Cited

U.S. PATENT DOCUMENTS

| | | | | |
|---|---|---|---|---|
| 4,973,271 | A | 11/1990 | Ishizuka et al. | |
| 5,586,902 | A * | 12/1996 | Hopf | H01R 13/6273 439/188 |
| 2012/0142205 | A1 | 6/2012 | Buethe et al. | |
| 2014/0295685 | A1 | 10/2014 | Wimmer | |

FOREIGN PATENT DOCUMENTS

| | | | |
|---|---|---|---|
| DE | 27 07 122 | A1 | 9/1977 |
| DE | 10 2009 057 688 | A1 | 6/2011 |
| DE | 10 2013 205 447 | A1 | 10/2014 |
| WO | WO 2011/070048 | A1 | 6/2011 |

* cited by examiner

*Primary Examiner* — Renee S Luebke
*Assistant Examiner* — Paul Baillargeon
(74) *Attorney, Agent, or Firm* — Finnegan, Henderson, Farabow, Garrett & Dunner LLP

(57) ABSTRACT

Embodiments disclose an electrical connector comprising a contact part including a sleeve enclosing a receiving space; a contact spring; and a locking pin including an axial end protruding laterally beyond the sleeve, the locking pin configured to be displaceably guided in the sleeve between a first final position and a second final position, be in contact with the contact spring, and push the contact spring towards the receiving space to a degree depending on a position of the locking pin between the first and second final positions; and a housing surrounding the contact part, the housing including a securing element configured to be selectively movable or fixed relative to the sleeve, grip the at least one axial end of the locking pin to form a locked connection, and selectively move the locking pin during a movement relative to the sleeve or fix the locking pin relative to the sleeve.

20 Claims, 5 Drawing Sheets

ELECTRICAL CONNECTOR AND ELECTRICAL PLUG CONNECTION

CROSS REFERENCE TO RELATED APPLICATIONS

This application is based upon and claims the benefit of prior German Patent Application No. 10 2015 114 080.2, filed on Aug. 25, 2015, the entire contents of which are incorporated herein by reference.

TECHNICAL FIELD

The present disclosure relates to an electrical connector, in particular to a high-current plug connector for voltages of up to 1000 volts and electric currents of up to 250 A. The present disclosure further relates to an electrical plug connection, in particular a high-current plug connection, comprising a socket for inserting such a plug connector. The connector and the plug connection implementable with the connector can be used in a vehicle, such as a motor vehicle, hybrid vehicle, or electric vehicle.

BACKGROUND

German Patent Application No. 10 2015 104 377.7 discloses an electrical connector. While the connector described therein allows an insertion contact that can be connected to the connector to be introduced and removed easily and offers comparatively high resistance to vibrations, a desire exists for a further improvement with respect to the vibration resistance. Moreover, a desire exists for a protection of a contact part of the connector from damage caused by mechanical stress or other external environmental influences.

German Patent Application No. 10 2013 205 447 A1 discloses a connection position assurance (CPA) used to render a properly joined, and consequently properly closed, plug connection visible, in particular when manually joining electrical connectors to form an electrical plug connection. A CPA can also prevent the plug connection from inadvertently becoming released,

SUMMARY

Embodiments of the present disclosure provide an electrical connector and an electrical plug connection, which allow a comparatively high resistance to vibrations and simple and secure assembly.

Embodiments of the present disclosure disclose an electrical connector suitable for high-current applications and comprising a contact part, which has a sleeve, a contact spring disposed in the sleeve, and a locking pin that is displaceably guided in the sleeve and bears against the contact spring. Depending on the position of the locking pin between a first, unlocked final position and a second, locked final position, the locking pin pushes the contact spring to varying degrees in the direction of a receiving space for a mating plug contact that can be introduced into the sleeve, the receiving space being formed in the sleeve.

According to embodiments of the present disclosure, the connector comprises a housing which surrounds the contact part and includes a securing element that can selectively be movable relative to the sleeve, or be fixed. The securing element embraces at least one axial end of the locking pin protruding beyond the sleeve to the outside such that the securing element selectively entrains the locking pin during a movement relative to the sleeve, or fixes the locking pin relative to the sleeve. This means that the securing element is able to both secure the locking pin against inadvertent movements along the sleeve as well as to actively move the locking pin. The housing can, for example, be latchingly locked on the contact part, and in particular on catch tabs serving as a primary locking mechanism, and optionally by way of a secondary locking mechanism clamping the housing in place, to fix the housing in a stationary manner with respect to the contact part or the sleeve.

The connector according to embodiments of the present disclosure combines a contact part with a protective housing and a CPA. The contact part allows an insertion contact to be introduced at comparatively low force expenditure, but provides high contact forces to act on the inserted insertion contact. The CPA is formed by a cooperation of the housing, the securing element guided thereon or therein, and optionally a socket of a plug connection that can be implemented with the connector. The securing element can be inserted into the housing and guided by the inner sides of the housing, for example three sides of the housing. The securing element has a substantially U-shaped base body, which encloses the contact part on three sides. The spring arm or the spring arms can be located outside the housing, or be held by the same on the contact part.

The connector according to embodiments of the present disclosure and a plug connection implementable with the connector have a particularly high resistance to vibrations in this configuration, as well as low plug and pull forces, while simultaneously offering high protection against mechanical stress or damage caused by external environmental influences. This plug connection may be suitable for high-current applications in motor vehicles, hybrid vehicles, and electric vehicles, wherein the connector and the related plug connection can be designed for voltages of up to approximately 1000 volts and electric currents of up to approximately 250 A.

According to embodiments of the present disclosure, the securing element, for the purpose of embracing the locking pin, comprises at least one spring arm that extends in the plug-in direction, laterally from the contact part and/or from the connector, and has an engagement groove that receives the axial end. A spring arm may be understood to mean an arm-shaped element that is integrally formed on the securing element only in sections and, as a result, can be deflected with respect to the same preferably transversely to the plug-in direction of the connector. The securing element may have a one-piece design, which may be implemented cost-efficiently as a thermoplastic part using an injection molding process. The at least one spring arm can extend along a narrow side of the contact part or of the sleeve.

According to embodiments of the present disclosure, the securing element is guided on or in the housing so as to be situated relative to the housing between a preliminary latched position, in which the locking pin is in the first final position, and a final latched position, in which the locking pin is in the second final position. The correct insertion and locking of the connector may be visually determined solely based on the determination that the securing element is in the final latched position and not in the preliminary latched position.

In embodiments of the present disclosure, the securing element comprises a flexible web extending on an upper face of the contact part and/or of the connector for releasably bringing the same into latching engagement with a flexible tongue of the housing, to fix the securing element relative to the housing and/or relative to the sleeve, for example in the preliminary latched position. By fixing the securing element with respect to the housing (which is stationary relative to the sleeve or to the contact part) and/or the sleeve, the securing element can be fixed in the preliminary latched position until just prior to the plug-in process. In this way, inadvertent plugging-in can be avoided. Together with the securing element, the locking pin can thus also be fixed relative to the housing and/or the sleeve. The flexible web is preferably configured in one piece with the securing element. The flexible tongue is likewise configured in one piece with the housing.

In embodiments of the present disclosure, the flexible tongue comprises at least one catch web extending transversely to the plug-in direction of the contact part for bringing the same into latching engagement with a catch groove or a catch edge of the flexible web. Such a catch web, and the catch groove or catch edge cooperating therewith, can be provided as an injection-molded part, for example made of a thermoplastic resin.

In embodiments of the present disclosure, to facilitate easier handling of the connector, the flexible tongue can be released from the latching engagement with the catch groove or the catch edge by a deflection of the flexible tongue and/or of the flexible web. This deflection only requires the flexible tongue and/or the flexible web to be pressed or lifted in a direction transversely to the plug-in direction. This course of movements can be effected even in difficult installation situations in a vehicle.

In embodiments of the present disclosure, to improve the handling of the connector if the flexible web, for the purpose of a seesaw-like deflection, is integrally formed on the securing element between a free, first axial end and a free, second axial end. The flexible web can thus be designed in one piece with the securing element. The seesaw-like deflection requires comparatively simpler courses of movement.

In embodiments of the present disclosure, the connector can be inserted into a socket with greater ease if the flexible web, for the purpose of releasing the latching engagement (between the securing element and the flexible tongue, for example in the preliminary latched position), can be deflected during insertion of the contact part into a socket by moving beyond a mating detent device, such as a mating catch lug or a mating catch web. In this way, the securing element may be released with respect to the housing solely by the insertion into the socket, so that no further courses of movement are required.

For locking the connector to the socket in a manner that is secure, but simple in terms of the design and movements, embodiments of the present disclosure provide that the securing element, which has been released from the fixation with the housing and can be moved relative to the housing, comprises a detent device by way of which the securing element can be brought into latching engagement with the mating detent device of the socket, for example in the final latched position. In the final latched position of the connector, the connector can thus be securely fastened to the socket. If the flexible web of the securing element is automatically deflected by the mating detent device and released from a latching engagement with the housing, it is sufficient for fixation to simply move the connector further in the plug-in direction until the connector securely latchingly locks thereon.

In embodiments of the present disclosure, the connector is more robust, and thus also suitable for plug connections subjected to particularly high mechanical stress, if the flexible tongue, for the purpose of a one-sided deflection, is integrally formed on the housing at a first axial end and a second axial end is freely deflectable relative to the housing, wherein a catch web of the flexible tongue can be brought into latching engagement with a catch groove of the flexible web, for example in the preliminary latched position. Compared to a design where the flexible tongue is integrally formed in a seesaw-like manner, the one-sided integrally formed design can be comparatively robust.

In embodiments of the present disclosure, for a higher mechanical stress tolerance, the catch web, which has been released from the fixation with the securing element by way of deflection and can be moved relative to the securing element, may be brought into latching engagement with the mating catch web of the socket, for example in the final latched position. This means that it is not the securing element, but the housing fastened to the contact part which latchingly locks on the socket. The plug connection can thus be designed to be robust.

Embodiments of the present disclosure also relate to an electrical plug connection, comprising an electrical connector in one or more of the above-described variant embodiments and comprising a socket for inserting the connector. The contact part of the connector can be brought in contact with an insertion contact of the socket, and this can be locked in the connector.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1:
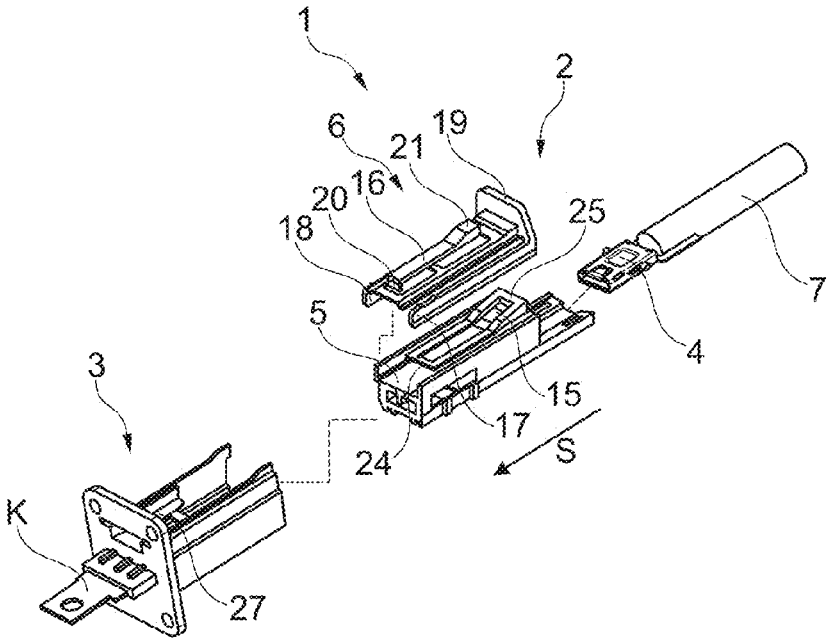
FIG. 1 shows an exploded view of an exemplary electrical plug, comprising an electrical connector and a socket.

The figures are only schematic representations and are provided only to explain the present disclosure. Like or like-acting elements are uniformly denoted by like reference numerals.

FIG. 1 shows an electrical plug connection 1 according to a first exemplary embodiment of the present disclosure in an exploded view. This plug connection 1 can be used, for example, as a high-current plug connection for voltages of up to approximately 1000 volts and electric currents of up to approximately 250 A in a vehicle.

The plug connection 1 comprises an electrical connector 2 and a socket 3, into which the connector 2 can be inserted so as to provide the electrically conductive plug connection 1. The connector 2 is inserted into the socket 3 in a plug-in direction S so as to provide the plug connection 1. For example, the socket 3, which is also referred to as a header, is part of or connected to an electrical fuse or an electrical power distributor of a vehicle.

The connector 2 comprises a contact part 4 and a housing 5 that surrounds the contact part 4 and comprises a securing element 6. The securing element 6 cooperates with the housing 5 and/or the socket 3 so as to form a CPA, the operating principle of which is described in greater detail hereafter.

An electrical line 7 is attached to the contact part 4 and is routed here to an electrical load (not shown) of the vehicle. The socket 3 is configured to receive the connector 2, together with the contact part 4, the housing 5 surrounding the same, and the securing element 6, in a plug-in manner. In this way, the plugged-in plug connection 1 allows electric current to flow from an energy or voltage source (not shown) of the vehicle, via the socket 3, the connector 2 including the contact part 4, and the electrical line 7 connected thereto, to the electrical load (not shown) of the vehicle.

Figure 2:
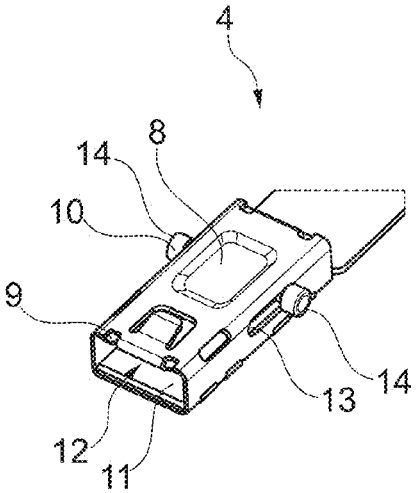
FIG. 2 shows a perspective top view onto an exemplary contact part, wherein a locking pin of the contact part is in an open or unlocked, first final position.

FIG. 2 shows the contact part 4 in a perspective top view. The construction of the contact part 4 is described in German Patent Application No. 10 2015 104 377.7, the entire contents of which are incorporated herein by reference. The contact part 4, for example, comprises a sleeve 8, a contact spring 9 disposed therein, and a locking pin 10, which bears against the contact spring 9. The contact part 4 furthermore comprises a plate-shaped contact tab 11, wherein a receiving space 12 for receiving, in a plug-in manner, an electrical insertion contact K of the socket 3, which extends through the socket 3 here, is formed between the contact spring 9 and the contact tab 11. The locking pin 10 is configured to push the contact spring 9 down in the direction of the contact tab 11 so as to selectively narrow or widen the receiving space 12.

The locking pin 10 extends in a direction transversely to the plug-in direction S through the sleeve 8 and is guided in lateral slots 13 of the sleeve 8. The axial ends of the slots 13 in the plug-in direction S limit the mobility of the locking pin 10 to an unlocked, first final position shown in FIG. 2 and a locked, second final position (see FIG. 3), between which the locking pin 10 is displaceable. The two axial ends 14 of the locking pin 10 protrude from the slots 13 beyond the sleeve 8. In the unlocked, first final position of the locking pin 10, the receiving space 12 is widened by the spaced positioning of the contact spring 9 from the contact tab 11, so that the insertion contact K can be inserted into the receiving space 12 with comparatively little force expenditure. In contrast, the receiving space 12 is narrowed in the locked, second final position of the locking pin 10 so as to clamp the insertion contact K by the contact spring 9 being pushed down in the direction of the contact tab 11. Disposed between the first and second final positions, the locking pin 10 pushes through a corresponding configuration of the contact spring 9 in the direction of the receiving space 12 to varying degrees. Depending on the position along the slots 13, the locking pin 10 displaces the contact spring 9 to a varying degree downward in the direction of the contact tab 11. In this way, it is possible to set a contact force acting on the insertion contact K in the receiving space 12 by way of the position of the locking pin 10.

Figure 3:
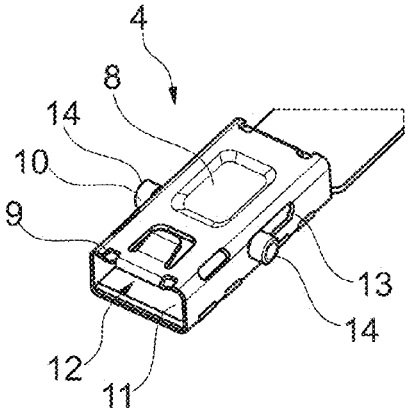
FIG. 3 shows a perspective top view onto the contact part from FIG. 2, wherein the locking pin of the contact part is in a locked, second final position.

FIG. 3 shows the contact part 4 from FIG. 2 in a perspective top view, wherein the locking pin 10 is now in the locked, second final position.

Figure 4:
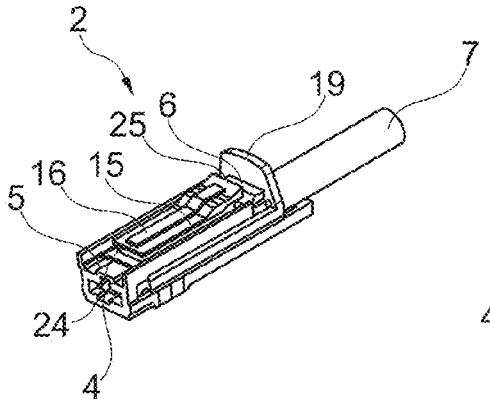
FIG. 4 shows a perspective side view of an exemplary electrical connector.

FIG. 4 shows the contact part 4, together with the housing 5 surrounding the contact part 4 and the securing element 6 cooperating therewith, according to a first exemplary embodiment in a perspective view. The CPA implementable therewith is in the preliminary latched position in this illustration, in which the locking pin 10 is in the first final position, i.e. the unlocked final position.

In this exemplary embodiment, the securing element 6 is displaceably guided in the housing 5, for example between the contact part 4 and the housing 5 along the plug-in direction S. The housing 5 comprises a substantially slotted sleeve-shaped main body, by way of which it surrounds the contact part 4. The securing element 6 is received between the contact part 4 and the housing 5 and held displaceably therein by three (inner) sides of the housing 5. By way of a primary locking mechanism (not visible here) described in the German Patent Application No. 10 2015 104 377.7, which engages in catch tabs of the contact part 4, and by way of a secondary locking mechanism in the form of a clip connection, the housing 5 is held in a stationary manner on the contact part 4. The housing 5 furthermore comprises a flexible tongue 15, which can be deflected relative to the main body of the housing and transversely to the plug-in direction S and the function of which is described hereafter.

The securing element 6 comprises a U-shaped main body, which is open toward the contact part 4 and includes a flexible web 16 that extends in the plug-in direction S and can be deflected transversely to the plug-in direction S. In the shown assembled state, the flexible web 16 of the securing element 6 is disposed within the flexible tongue 15 of the housing 5. Moreover, two spring arms 17 and 18 of the securing element 6, which can be deflected transversely to the plug-in direction S and transversely to the deflection direction of the flexible web 16, extend on the narrow sides of the contact part 4, i.e. laterally thereof. At an axial end of the securing element 6 in the plug-in direction S, this comprises a stop collar 19, which in the shown preliminary latched position is spaced from the housing 5 and, in a final latched position (not shown in FIG. 4) is stopped against the housing 5.

Figure 5:
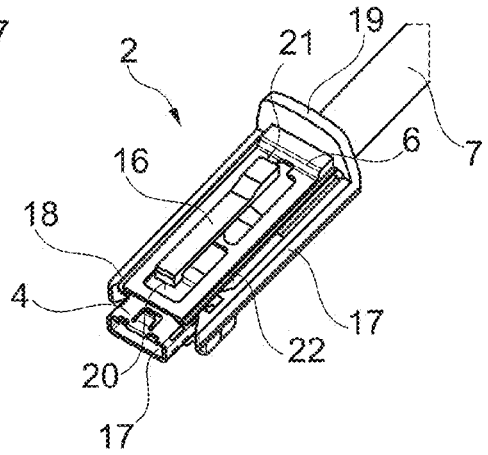
FIG. 5 shows a perspective top view onto the electrical connector from FIG. 4, wherein a housing is hidden to better illustrate a securing element.

As shown in FIG. 5, which shows the connector 2 from FIG. 4 without the housing 5 to better illustrate the securing element 6, the flexible web 16 is integrally formed on the securing element 6 between the first axial end and the second axial end of the securing element. The flexible web 16 can be deflected in a seesaw-like manner with respect to the main body of the securing element 6 about this integrally formed area. At a first axial end, the flexible web 16 comprises a catch hook 20, which is formed in the direction of the contact part 4 and can be brought into latching engagement with the socket 3 and/or the housing 5, and at a second axial end, the flexible web comprises a catch edge 21, which can be brought into latching engagement with the housing 5. It is furthermore shown in FIG. 5 that, toward the contact part 4, the spring arms 17, 18 of the securing element 6 each comprise an engagement groove 22 and 23 for receiving the axial ends 14 of the locking pin 10, wherein in this view only the engagement groove 22 can be seen. For installing the securing element 6 on the contact part 4, the spring arms 17, 18 can be deflected outwardly beyond the axial ends 14 of the locking pin 10. In the installed state, the engagement grooves 22, 23 embrace the axial ends 14 of the locking pin 10. This at least form-locked connection allows the locking pin 10 to be entrained by the securing element 6 during a movement relative to the contact part 4, or to be fixed or retained relative to the contact part 4 during a fixation thereof.

Based on FIGS, 6 and 7, which show the electrical plug connection 1 together with the connector 2 inserted into the socket 3 according to the first exemplary embodiment in a perspective side view in the preliminary latched position (FIG. 6) and in the final latched position (FIG. 7), the function of plugging in the plug connection 1, and in particular the function of the CPA, shall be described hereafter.

Figure 6:
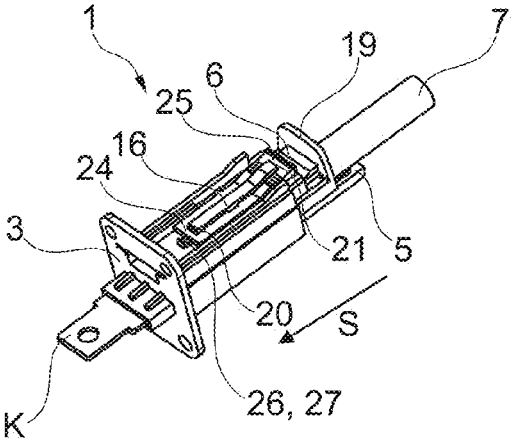
FIG. 6 shows a perspective side view of an exemplary electrical plug connection comprising a socket and a connector inserted therein, wherein the connector is in the preliminary latched position thereof.

The description proceeds from the preliminary latched position of the securing element 6 displaceably guided in the housing 5, as shown in FIG. 6. In this preliminary latched position, neither the flexible tongue 15 of the housing 5 nor the flexible web 16 of the securing element 6 is deflected. A first catch web 24 and a second catch web 25, spaced axially therefrom, of the flexible tongue 15 are thus in latching engagement with the catch hook 20 and the catch edge 21 of the securing element 6. In this way, the securing element 6 is held by the latching engagement with the housing 5 relative to the same and thus cannot be displaced with respect to the same. In the preliminary latched position, the locking pin 10 is in its unlocked, first final position thereof, so that the insertion contact K of the socket 3 can, in principle, be inserted into the receiving space 12 of the contact part 4.

FIG. 6 shows socket 3, which comprises a mating detent device 26 having a mating catch lug 27 for a latching engagement with the catch hook 20, and a chamfered sliding surface 28 for the catch hook 20 to slide thereon. When the connector 2 moves in the plug-in direction S from the preliminary latched position in the direction of the final latched position, the flexible web 16 and its catch hook 20 are pushed over the chamfered sliding surface 28. The flexible web 16 is thereby upwardly deflected relative to the flexible tongue 15 (in FIG. 6) at the axial end comprising the catch hook 20, whereby the seesaw-like deflection of the other axial end releases the latching engagement between the catch hook 20 and the catch web 24, and between the catch edge 21 and the catch web 25.

Figure 7:
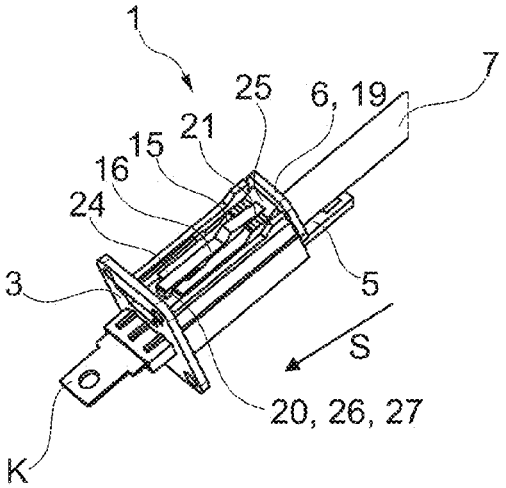
FIG. 7 shows a perspective side view of the electrical plug connection from FIG. 6, wherein the connector is in the final latched position, in which a locking pin of a contact part is in the locked, second final position.

After the release, the securing element 6 can be displaced relative to the housing 5 in the plug-in direction S, and the catch hook 20 can consequently be latchingly locked on the mating catch lug 27 of the mating detent device 26, as is shown in FIG. 7. In other words, the connector 2 can only be completely plugged onto the socket 3 when the securing element 6 is unlocked by a deflection by the mating detent device 26 with respect to the housing 5.

FIG. 7 shows the final latched position of the connector 2, in which the catch hook 20 is in latching engagement with the mating catch lug 27 of the mating detent device 26, and the locking pin 10 is in its locked, second final position. The connector 2 is thus plugged completely into the insertion contact K of the socket 3 and latchingly locked on the socket 3. This latchingly locked connection constitutes the correct latchingly locked connection in the manner of a CPA. The stop collar 19 of the securing element 6 is stopped against the axial end of the housing 5, so that the correct latchingly locked connection is also visually identifiable.

Figure 8:
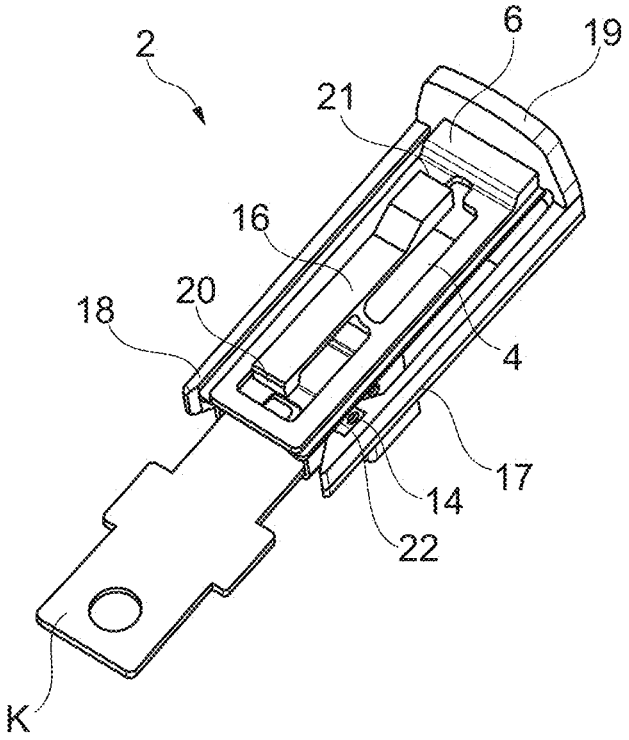
FIG. 8 shows a perspective top view onto the connector from FIG. 7, wherein the housing and the socket are hidden for the sake of better illustration.

In FIG. 8, which shows a perspective top view onto the connector 2 from FIG. 7 in the final latched position, the housing 5 and the socket 3 are hidden for the sake of better illustration. It is thus apparent that the engagement grooves 22, 23 of the spring arms 17, 18 fix the locking pin 10 with respect to the sleeve 8 of the contact part 4 by embracing the locking pin 10 in the final latched position.

The securing element 6 itself is fixed relative to the socket 3 and/or the housing 5 by the above-described latching engagement with the mating detent device 26.

Figure 9:
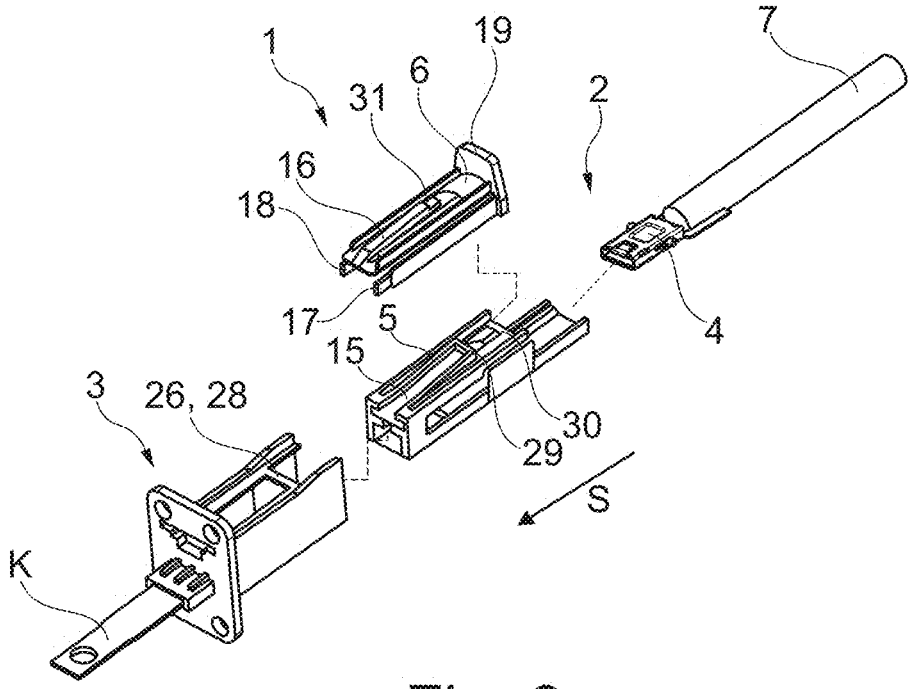
FIG. 9 shows an exploded view of an exemplary electrical plug connection comprising a socket and an electrical connector.

FIG. 9 shows a further exemplary embodiment of the plug connection 1 in an exploded view. To avoid repetition, only the essential differences compared to the first exemplary embodiment will be described hereafter. These differences mainly include the design configuration of the socket 3, of the housing 5, and of the securing element 6.

With respect to the socket 3, FIG. 9 shows that the mating detent device 26 in this exemplary embodiment is not designed as a mating catch lug 27, but as a mating catch web 28 extending transversely to the plug-in direction S. The housing 5 of this exemplary embodiment differs from the preceding exemplary embodiment in that the flexible tongue 15 is integrally formed on the housing 5 on one side and can be deflected about this integrally formed area. Axially spaced from this area, a catch web 29 extending transversely to the plug-in direction S is formed on the flexible tongue 15 for creating a latching engagement with the mating catch web 28. Moreover, the flexible tongue 15 comprises an actuating tab 30 for manual actuation. With respect to the securing element 6, this differs from the preceding exemplary embodiment in that the flexible web 16, for the purpose of one-sided deflection, is not integrally formed on an axial end in a seesaw-like manner, but is likewise integrally formed on one side. The catch web 16 comprises a catch groove 31 for bringing the same into latching engagement with the catch web 29 of the flexible tongue 15 of the housing 5.

Figure 10:
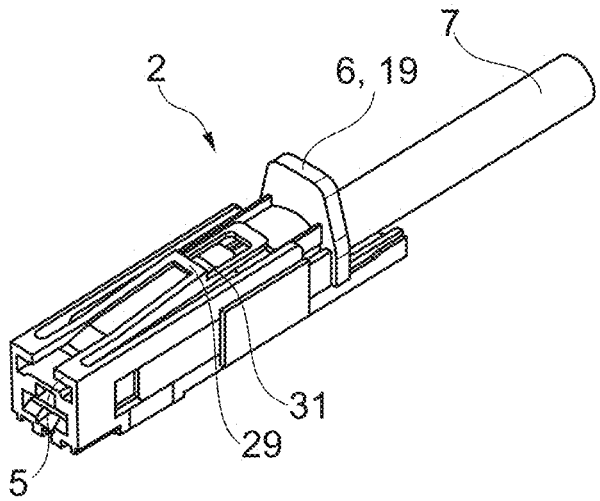
FIG. 10 shows a perspective &de view of an exemplary electrical connector, wherein the connector is in the preliminary latched position.
Figure 11:
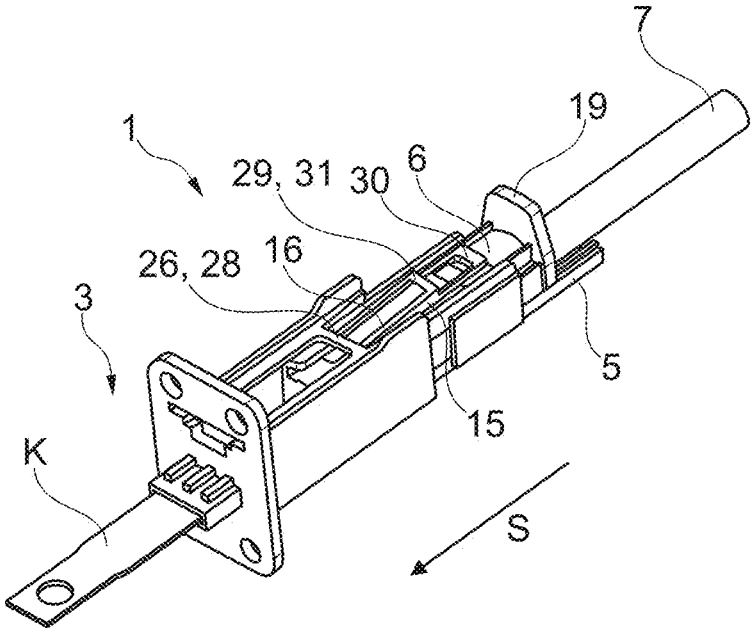
FIG. 11 shows a perspective side view of an exemplary electrical plug connection, wherein the connector is in the preliminary latched position.
Figure 12:
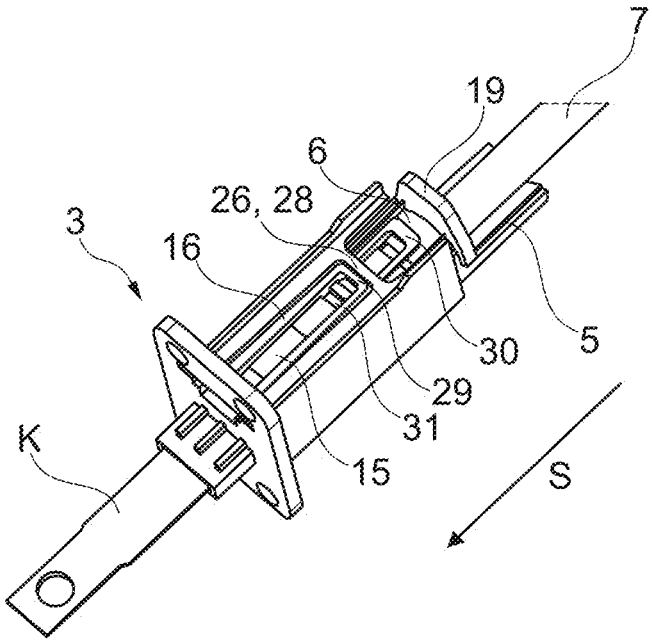
FIG. 12 shows a perspective top view onto an exemplary electrical plug connection, wherein the connector is in the final latched position.

Based on FIGS. 10 to 12, which show the connector 2 or the electrical plug connection 1 together with the connector 2 inserted into the socket 3 according to the second exemplary embodiment in a perspective side view in the preliminary latched position (FIGS. 10 and 11) and in the final latched position (FIG. 12), the function of plugging in the plug connection 1, and in particular the function of the CPA, shall be described hereafter.

The description proceeds from FIG. 10, in which the securing element 6 is in the preliminary latched position. The stop collar 19 is axially spaced from the axial end of the housing 5. The spring arms 17, 18 of the securing element 6 embracing and entraining the axial ends 14 of the locking pin 10 cause the locking pin 10 to assume the unlocked, first final position thereof. To hold the securing element 6 relative to the housing 5 in the preliminary latched position, the catch web 29 of the flexible tongue 15 is in latching engagement with the catch groove 31.

In FIG. 11, the connector 2 is partially introduced into the socket 3, wherein a complete insertion is blocked by the flexible tongue 15, which with the catch web 29 engages in the catch groove 31, being deflected (upwardly in FIG. 11) with respect to the main body of the housing 5, and the flexible tongue 15 thereby being seated against the mating catch web 28 of the socket 3. To be able to push the connector 2 beyond this blocked position and into the socket 3, initially the catch web 29 must be lifted out of the catch groove 31 by a deflection of the actuating tab 30 (upwardly in FIG. 11). As a result, the securing element 6 can be displaced in the plug-in direction S relative to the housing 5 until stopped at the stop collar 29. After the securing element 6 has been displaced relative to the housing 5, the flexible web 16 can be pushed, together with the flexible tongue 15, approximately into the horizontal.

In FIG. 12, which shows the plug connection 1 in a perspective top view, the securing element 6 is in the final latched position. Accordingly, the locking pin 10 entrained during the movement is in the locked, second final position. FIG. 12 shows that, in this position, the flexible tongue 15 is substantially nestled against the flexible web 16, and the two are approximately in the horizontal. Due to a latching engagement of the catch web 29 with the mating catch web 28 of the socket 3, the connector 2 is secured on said socket.

In this exemplary embodiment, the CPA is implemented in that the securing element 6 can be displaced relative to the housing 5, and thus moved from the preliminary latched position into the final latched position, only after the latching engagement between the catch web 29 and the catch groove 31 has been released. The correct locking of the connector 2 on the socket is then visually identifiable based on the latchingly locked connection of the catch web 29 on the mating catch web 28 of the socket 3, and based on the housing 5 being stopped at the stop collar 29.

LIST OF REFERENCE NUMERALS

1 electrical plug connection
2 electrical connector
3 socket/header
4 contact part (such as high-current contact part)
5 housing
6 securing element
7 electrical line
8 sleeve
9 contact spring
10 locking pin
11 contact tab
12 receiving space
13 slot(s)
14 axial end(s)
15 flexible tongue
16 flexible web
17 spring arm
18 spring arm
19 stop collar
20 catch hook
21 catch edge
22 engagement groove
23 engagement groove
24 first catch web
25 second catch web
26 mating detent device
27 mating catch lug
28 mating catch web
29 (further) catch web
30 actuating tab
31 catch groove
K insertion contact
S plug-in direction

What is claimed is:

1. An electrical connector, comprising:
a contact part comprising:
a sleeve enclosing a receiving space;
a contact spring secured to an inside of the sleeve; and
a locking pin comprising at least one axial end protruding laterally beyond the sleeve, the locking pin configured to:
be displaceably guided in the sleeve between a first final position and a second final position,
be in contact with the contact spring, and
push the contact spring towards the receiving space to a degree depending on a position of the locking pin between the first and second final positions; and
a housing surrounding the contact part, the housing comprising a securing element configured to:
be selectively movable or fixed relative to the sleeve,
grip the at least one axial end of the locking pin to form a locked connection, and
selectively move the locking pin during a movement of the securing element relative to the sleeve or fix the locking pin relative to the sleeve.

2. The connector according to claim 1, wherein the securing element comprises:
at least one spring arm extending laterally from the contact part, and
an engagement groove configured to receive the at least one axial end of the locking pin.

3. The connector according to claim 1, wherein the securing element is further configured to be displaceably guided in the housing between a preliminary latched position and a final latched position, wherein:
the preliminary latched position includes the locking pin in the first final position, and
the final latched position includes the locking pin in the second final position.

4. The connector according to claim 3, wherein the housing further comprises a flexible tongue and the securing element comprises a flexible web extending on an upper face of the contact part, the flexible web configured to form a releasably latching engagement with the flexible tongue of the housing in the preliminary latched position.

5. The connector according to claim 4, wherein:
the flexible web comprises a catch element, and
the flexible tongue comprises a catch web extending transversely to a plug-in direction of the contact part, the catch web configured to form a latching engagement with the catch element of the flexible web.

6. The connector according to claim 5, wherein the flexible tongue is configured to be released from the latching engagement with the catch element by a deflection of at least one of the flexible tongue or the flexible web transversely to the plug-in direction.

7. The connector according to claim 6, wherein the flexible web is configured to be deflected during insertion of the contact part into a socket having a mating detent device, the flexible web being deflected by moving beyond the mating detent device.

8. The connector according to claim 7, wherein the securing element comprises a detent device configured for latching engagement with the mating detent device of the socket in the final latched position.

9. The connector according to claim 8, wherein:

the mating detent device of the socket comprises a mating catch web, and the catch web of the flexible tongue is configured for latching engagement with the mating catch web of the socket in the final latched position.

10. The connector according to claim 5, wherein the catch element is one of a catch groove or a catch edge.

11. The connector according to claim 5, wherein the flexible web is integrally formed on the securing element between a first axial end of the securing element and a second axial end of the securing element.

12. The connector according to claim 11, wherein:

the flexible tongue is configured for one-sided deflection, the flexible tongue being integrally formed on the housing at the first axial end of the housing, and freely deflectable relative to the housing at the second axial end of housing, and the catch web of the flexible tongue is configured for latching engagement with the catch element of the flexible web in the preliminary latched position.

13. An electrical plug connection, comprising;

an electrical connector, comprising:

a contact part comprising:

a sleeve enclosing a receiving space;

a contact spring secured to an inside of the sleeve; and a locking pin including at least one axial end protruding laterally beyond the sleeve, the locking pin configured to:

be displaceably guided in the sleeve between a first final position and a second final position, be in contact with the contact spring, and push the contact spring towards the receiving space to a degree depending on a position of the locking pin between the first and second final positions;

a housing surrounding the contact part, the housing comprising a securing element configured to:

be selectively movable or fixed relative to the sleeve, grip the at least one axial end of the locking pin to form a locked connection, and selectively move the locking pin during a movement relative to the sleeve or fix the locking pin relative to the sleeve; and a socket configured to receive the electrical connector to form a secure plug connection.

14. The electrical plug connection according to claim 13, wherein the securing element is further configured to be displaceably guided in the housing between a preliminary latched position and a final latched position, wherein:

the preliminary latched position comprises the locking pin in the first final position, and the final latched position comprises the locking pin in the second final position.

15. The electrical plug connection according to claim 14, wherein the housing further comprises a flexible tongue and the securing element comprises a flexible web extending on an upper face of the contact part, the flexible web configured to form a releasably latching engagement with the flexible tongue of the housing in the preliminary latched position.

16. The electrical plug connection according to claim 15, wherein:

the flexible web further comprises a catch element, and the flexible tongue comprises a catch web extending transversely to a plug-in direction of the contact part, the catch web configured to form a latching engagement with the catch element of the flexible web.

17. The electrical plug connection according to claim 16, wherein the flexible tongue is configured to be released from the latching engagement with the catch element by a deflection of at least one of the flexible tongue or the flexible web transversely to the plug-in direction.

18. The electrical plug connection according to claim 17, wherein the flexible web is configured to be deflected during insertion of the contact part into a socket having a mating detent device, the flexible web being deflected by moving beyond the mating detent device.

19. The electrical plug connection according to claim 18, wherein the securing element comprises a detent device configured for latching engagement with the mating detent device of the socket in the final latched position.

20. A high-current connection system for a vehicle, comprising:

an electrical connector, comprising:

a contact part comprising:

a sleeve enclosing a receiving space;

a contact spring secured to an inside of the sleeve; and a locking pin comprising at least one axial end protruding laterally beyond the sleeve, the locking pin configured to:

be displaceably guided in the sleeve between a first final position and a second final position, be in contact with the contact spring, and push the contact spring towards the receiving space to a degree depending on a position of the locking pin between the first and second final positions;

a housing surrounding the contact part, the housing comprising a securing element configured to:

be selectively movable or fixed relative to the sleeve, grip the at least one axial end of the locking pin to form a locked connection, and selectively move the locking pin during a movement relative to the sleeve or fix the locking pin relative to the sleeve; and a socket configured to receive the electrical connector to form a secure plug connection.

* * * * *